United States Patent [19]

Doyle

[11] Patent Number: 4,660,048

[45] Date of Patent: Apr. 21, 1987

[54] MICROSTRIP PATCH ANTENNA SYSTEM

[75] Inventor: David W. Doyle, Wyle, Tex.

[73] Assignee: Texas Instruments Incorporated, Dallas, Tex.

[21] Appl. No.: 683,217

[22] Filed: Dec. 18, 1984

[51] Int. Cl.[4] ..... H01Q 1/38

[52] U.S. Cl. ..... 343/700 MS; 343/830

[58] Field of Search ..... 343/700 MS, 829, 830

[56] References Cited

U.S. PATENT DOCUMENTS

| | | | |
|---|---|---|---|
| 2,998,605 | 8/1961 | Orlando | 343/829 |
| 3,016,536 | 1/1962 | Fubini | 343/829 |
| 4,070,676 | 1/1978 | Sanford | 343/829 |
| 4,218,682 | 8/1980 | Frosch | 343/830 |
| 4,364,050 | 12/1982 | Lopez | 343/700 MS |
| 4,605,932 | 8/1986 | Butscher et al. | 343/700 MS |

*Primary Examiner*—Eli Lieberman

*Attorney, Agent, or Firm*—Richard K. Robinson; Leo N. Heiting; Melvin Sharp

[57] ABSTRACT

A microstrip antenna system is comprised of either a single antenna element (patch) or a plurality of stacked antenna elements having one or more feedpins connected to a corresponding number of conductive elements (flags) capacitively coupled to the antenna element or elements. The one or more feedpins have an inductive reactance which is cancelled by trimmed flags to provide the capacitance necessary to cancel the inductance for tuning the one or more antennas and providing maximum gain and minimum VSWR.

9 Claims, 4 Drawing Figures

MICROSTRIP PATCH ANTENNA SYSTEM

This invention relates to antennas and more particularly to microstrip antenna systems.

In the past, microstrip antennas referred to at common parlance as "patch antennas" have comprised a planar resonant radiating element parallel to, but separated, from a ground plane by a thin dielectric substrate. They have been fed from the back through the ground plane or from the edge by depositing microstrip lines on the dielectric substrate. Such antennas have been both linearly and circularly polarized.

More specifically these microstrip patches have been fed utilizing a microstrip feed that resided on the same substrate that the patch was on. This was convenient in that the feed network could be etched at the same time as the patch circuits. Microstrip tuning elements could also be incorporated into this design to match the voltage standing wave ratio (VSWR) of the patches. The problem with this design is its susceptability to electro magnetic pulses (EMP) from a nuclear detonation. This method of feeding a patch is described in U.S. Pat. No. 3,713,162 issued Jan. 23, 1973 to Robert E. Munson et al for a "Single Slot Cavity Antenna Assembly"

In the microstrip patch fed from the rear using a connector or coax cable, the ground of the coax or connector terminates on the ground plane of the patch and the center conductor passes up through the ground plane and patch substrate to terminate on the patch itself. A problem of this structure is that it to is susceptible to EMP coupling into the system.

Another problem with the above-mentioned patch antennas is that they could not be stacked using either of the known feed mechanisms and achieve a low VSWR through easily implemented impedance matching techniques.

Accordingly, it is an object of this invention to provide an improved microstrip antenna.

Another object of the invention is to provide a microstrip patch antenna having substantially reduced EMP coupling into the system.

Still another object of the invention is to provide a stacked microstrip patch antenna which allows the patches to be impedance matched to achieve a low VSWR.

Yet another object of the invention is to provide a stacked patch antenna having substantially increased bandwidth of the patches.

Briefly stated, this invention is comprised of a microstrip patch antenna having an open circuit microstrip line to capacitively couple the feed line to the patch element. In a stacked multiple frequency system, the upper patch is the ground plane for the open circuit microstrip line.

Other objects and features of the invention will become more readily apparent from the following detailed description when read in conjunction with the accompanying drawings in which.

Figure 1:
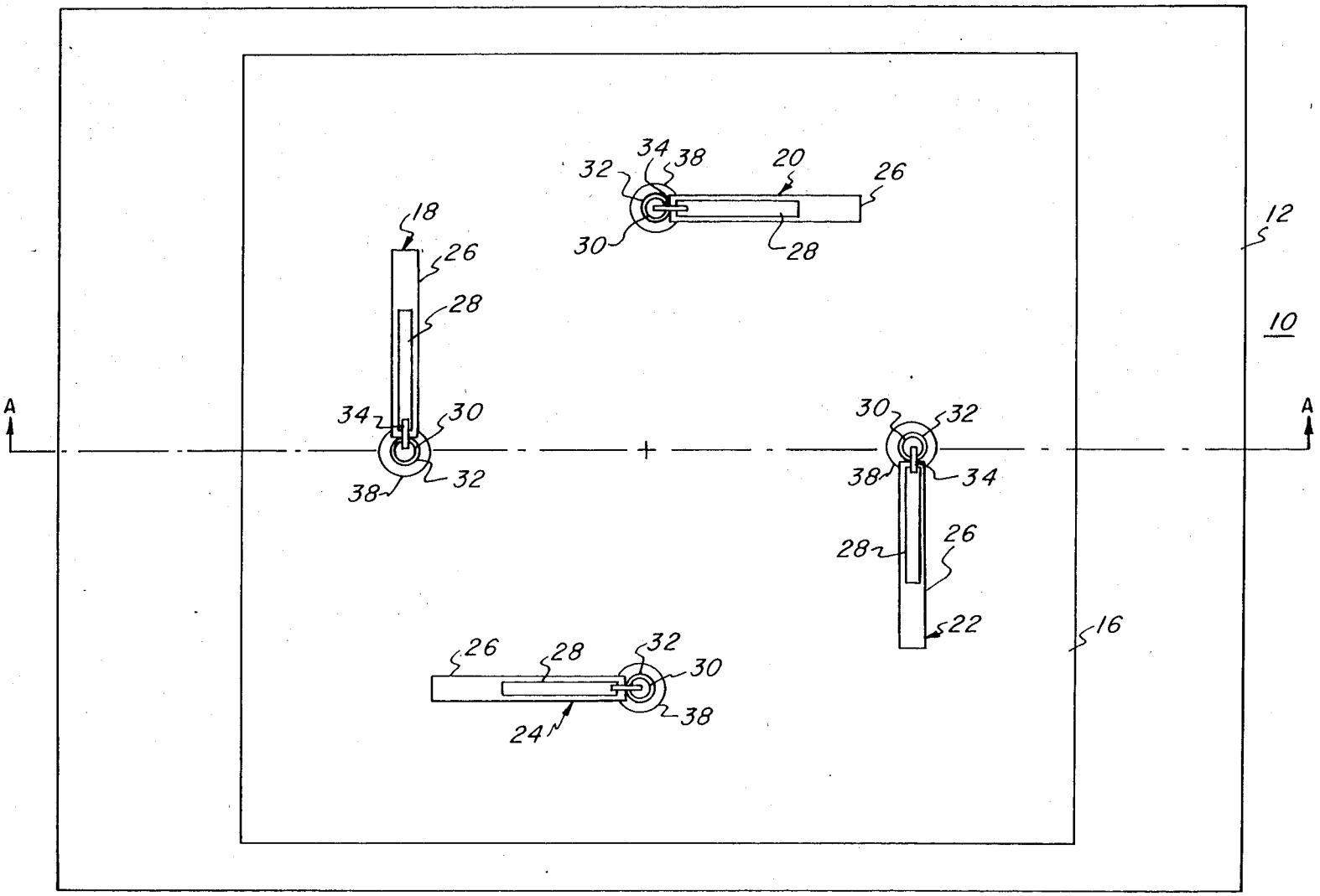
FIG. 1 is a plan view of the microstrip patch antenna constituting the subject matter of a first embodiment of the invention.
Figure 2:
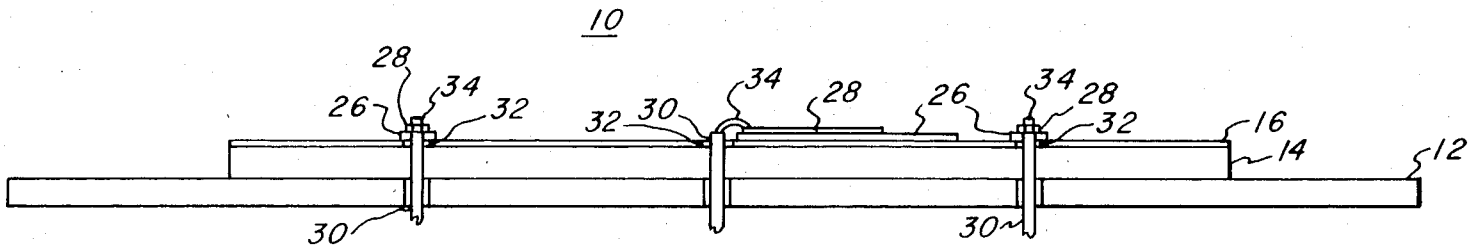
FIG. 2 is a cross-sectional view of the FIG. 1 microstrip patch antenna along the line A—A.

Referring now to FIG. 1, the capacitively coupled microstrip patch antenna 10 comprises a groundplane 12, dielectric 14 (FIG. 2), antenna element or patch 16 (FIG. 1) and capacitively coupled feed lines 18, 20, 22 and 24.

The groundplane 12 may be, for example, a copper or aluminum sheet and the dielectric layer may be, for example, a Teflon fiberglass substrate sold by the 3M company. The antenna element 16 is, for example, a layer of copper formed on the dielectric.

The capacitively coupled feed lines 18,20,22 and 24 are each comprised of an open electric circuit formed by a dielectric layer (an insulator) 26 over the patch 16 upon which the open circuit elements 28 (flags) are formed. Feed pins 30 pass through clearance holes 32 of the patch 16 and are soldered or wire bonded by leads 34 to the open circuit elements 28. Thus, as far as the dc path is concerned the patch is electrically isolated from the feed pin.

Figure 3:
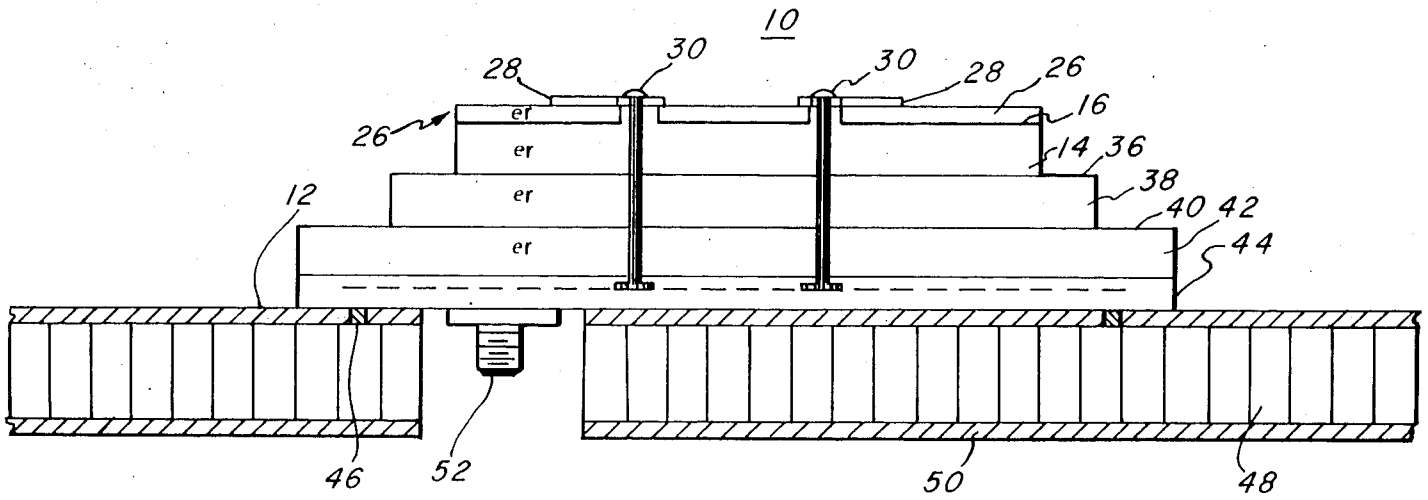
FIG. 3 is a cross-sectional view of a stacked multi-frequency patch antenna constituting a second embodiment of the invention.

Referring now to FIG. 3, in which a second embodiment of the invention consists of a multilayered patch antenna, an additional antenna elements (patches) 36 and 40 are separated by dielectric 38. Patches 36 and 40 act as groundplanes, respectively, for the antenna elements 16 and 36. Patch 40 is separated from a hybrid feed circuit 44 by a dielectric 42. The hybrid circuit 44, which is itself a stripline package, is mounted upon a metal clad ground plane 12. The hybrid circuit is an out-of-phase power divider providing, for our example, equal power 0. 90, 180, and 270 degrees out of phase to feed pins 18, 20, 22 and 24. Alignment of the hybrid circuit and ground plane is accomplished by alignment pins 46. The metal clad ground plane 12 is a copper clad Teflon fiberglass layer mounted upon a honeycomb substrate 48 mounted upon a mounting plate 50. Mounting plate 50 may be, for example, a fiberglass plate. The groundplane 12, honeycomb substrate 48 and mounting plate 50 form a light weight strongback mounting having walls forming an aperture for a polarized output 52.

It will be appreciated by those persons skilled in the art that with the capacitively coupled feedlines 22, 24, 18 and 20 (FIG. 1) being located at the 0, 90, 180, and 270 degree points, a circularly polarized antenna is provided. A circularly polarized antenna is used for descriptive purposes only and not by way of limitation. It will be readily appreciated by one skilled in the art that the invention can be employed with a linearly polarized antenna without departing from the scope of the invention. Those persons skilled in the art of patch antennas will recall that the centers of the patches 16, 36 and 40 are at zero potential and at the outer edges the potential is very high (hundreds of ohms); thus, a good 50 ohm match is achieved by selectively locating the feedpoints a distance from the center determined by trial and error. The characteristic impedance of the open circuited microstrip line is approximately equal to $$-jZ_oCotBl$$

where:

Z=characteristic impedance of microstrip line;

B=base constant of line (also 2 pi/lambda);

l=length of line; and lambda=the effective wavelength at the operating frequency.

As the length of the line approaches ¼ wavelength, the impedance approaches zero ohms. For lengths less than ¼ lambda, the impedance becomes capacitive. The microstrip patch utilizing a rear pin feed inherently has an inductive impedance owing to the length of the pin. The inductive reactance of the feed pins 30 is offset by the length of their flags 28 (FIG. 1). In the initial design, tuning is accomplished by trimming the length of the flags. This method of feeding is especially effective as it allows a variable capacitance to be introduced which cancels out the inductance of the feed pin. With an antenna as described herein, a 1.1 to 1.5 voltage standing wave ratio (VSWR) with maximum gain can be readily obtained.

Figure 4:
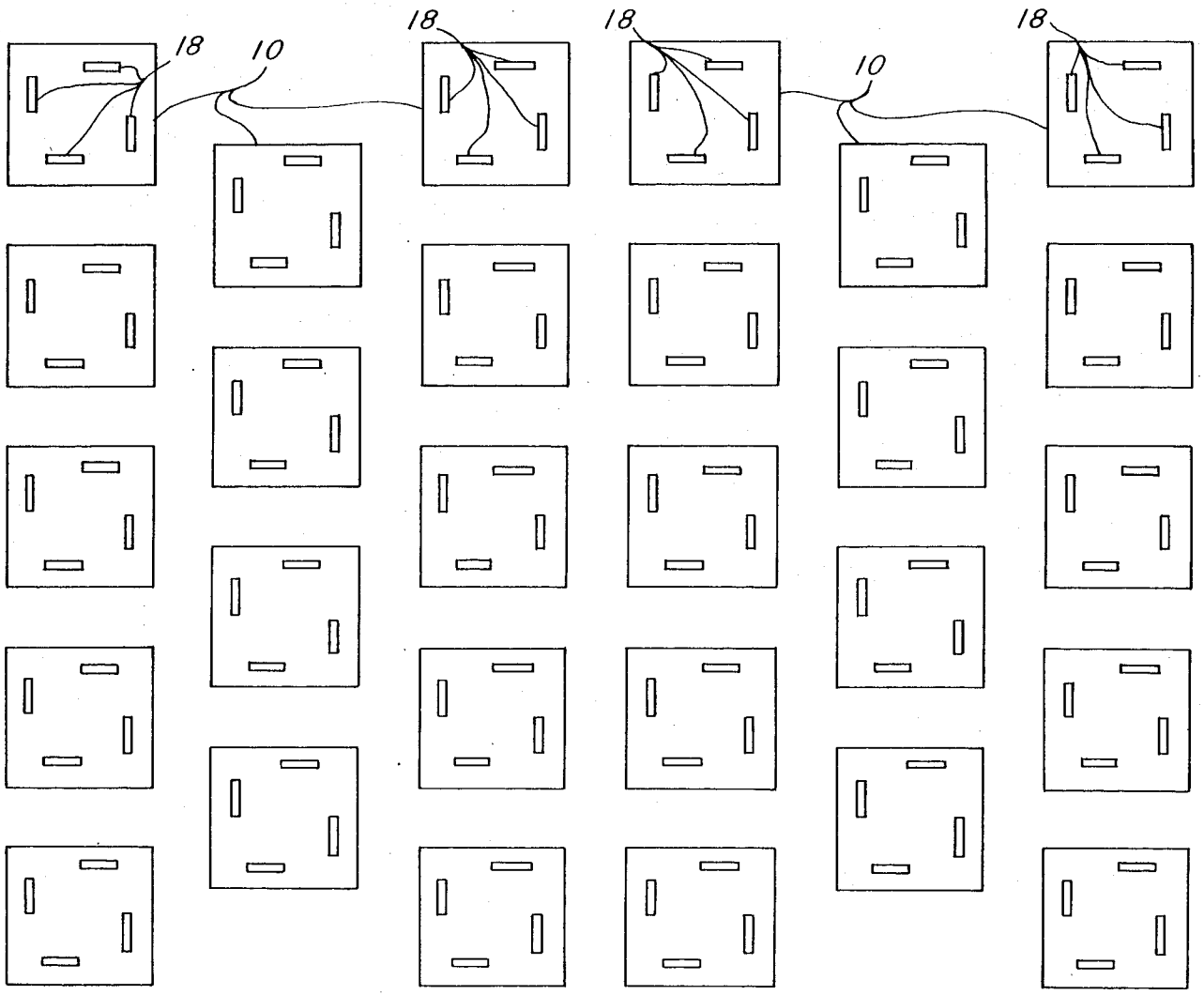
FIG. 4 is a plan view of a multiple patch antenna system.

The dimensions of the patches 16, 36 and 40 determine their frequencies. For example, in a global positioning system (GPS) with a nuclear detonation detection information function, the patches 16, 36 and 40 have frequencies of 1575 MHz, 1381 MHz and 1227 MHz, respectively. The 1575 and 1227 MHz frequencies of patches 16 and 40 are the GPS position determining frequencies and the 1381 frequency of patch 36 is the frequency of transmission used by nuclear detection systems. Any number of the multilayer patch antennas can be combined in a system (FIG. 4), for example, in the Ground/Airborne IGS Terminal twenty-eight such antennas are used.

Although several embodiments of this invention have been described, it will be apparent to a person skilled in the art that various modifications to the details of construction shown and described may be made without departing from the scope of this invention.

What is claimed is:

1. A microstrip antenna comprising:

(a) a groundplane substrate;

(b) a hybrid stripline circuit disposed above the groundplane substrate, said hybrid circuit having an input terminal for receiving microwave energy and an output port for outputting polarized microwave energy;

(c) a layer of dielectric material formed on the hybrid circuit;

(d) a plurality of antenna forming electrical conducting and dielectric layers alternatively formed on the ground plane of the hybrid circuit beginning with the electrical conductive layer and ending with a top dielectric layer; (e) a conductive flag formed on the top dielectric layer; and (f) a feedpin electrically interconnecting the hybrid circuit and conductor flag for capacitively feeding the antenna forming conductive layers.

2. A microstrip antenna according to claim 1 wherein, the groundplane substrate is a metal clad honeycomb dielectric structure forming a lightweight strongback mounting plate.

3. A microstrip antenna according to claim 1 wherein the hybrid circuit is a circularly polarized type hybrid circuit.

4. A microstrip antenna according to claim 1 wherein the hybrid circuit is a linear polarized type hybrid circuit.

5. A microstrip antenna according to claim 1 wherein the plurality of antenna forming electrical conductor and dielectric layers are copper clad dielectric layers.

6. A microstrip antenna according to claim 1 wherein the conductive flag is a variable length metal strip formed on the top dielectric layer.

7. A microstrip antenna according to claim 1 wherein the feedpin is electrically insulated from the antenna forming electrical conductive layers, selectively positioned from the centers of the antenna forming electrical conductors for forming a 50 Ohm matching impedance and forming an inductive reactance, said conductive flag having a preselected length for providing capacitance for cancelling the inductive reactance to tune the antenna and provide maximum gain.

8. A microstrip antenna according to claim 1 wherein the antenna forming conductive layers have preselected dimensions for antennas having preselected frequencies.

9. A microstrip antenna system comprising a plurality of the microstrip antenna according to claim 1.

* * * * *